US009115533B2

(12) United States Patent
Ng

(10) Patent No.: US 9,115,533 B2
(45) Date of Patent: Aug. 25, 2015

(54) PULL CLIP FOR BOTTOM BAR OF WINDOW SHADE

(76) Inventor: Philip Ng, Thornhill (CA)

( * ) Notice: Subject to any disclaimer, the term of this patent is extended or adjusted under 35 U.S.C. 154(b) by 349 days.

(21) Appl. No.: 13/588,120

(22) Filed: Aug. 17, 2012

(65) Prior Publication Data

US 2014/0047680 A1 Feb. 20, 2014

(51) Int. Cl.
*A41F 1/00* (2006.01)
*E06B 9/42* (2006.01)

(52) U.S. Cl.
CPC ..... *E06B 9/42* (2013.01); *E06B 2009/425* (2013.01); *Y10T 24/44017* (2015.01)

(58) Field of Classification Search
CPC .... F16B 2/243; F16B 2/245; E06B 2009/425; E06B 9/78; F21V 21/38
USPC ..... 24/257
See application file for complete search history.

(56) References Cited

U.S. PATENT DOCUMENTS

| | | | | |
|---|---|---|---|---|
| 2,795,834 | A * | 6/1957 | Szoke | 248/113 |
| 3,303,542 | A * | 2/1967 | Holton | 24/289 |
| 3,883,926 | A * | 5/1975 | Reynolds | 248/74.1 |
| 4,259,767 | A * | 4/1981 | Holton | 29/281.4 |
| 4,883,397 | A * | 11/1989 | Dubost | 411/174 |
| 7,360,745 | B2 * | 4/2008 | Nikayin et al. | 248/216.1 |
| 8,300,406 | B2 * | 10/2012 | Chen et al. | 361/679.55 |

* cited by examiner

*Primary Examiner* — Victor Batson
*Assistant Examiner* — Matthew Sullivan
(74) *Attorney, Agent, or Firm* — Hudak, Shunk & Farine Co. LPA

(57) ABSTRACT

A pull clip for the bottom bar of a window shade, the pull clip comprising a pair of arms joined by a bridge portion, the arms flexibly biased toward a rest position when displaced therefrom, at least a portion of the arms releasably receivable within one or more channels on the bottom bar, at least one of the arms or the bridge portion including an engagement member, the engagement member frictionally engaging the bottom bar when the arms are received within the one or more channels to restrain the movement of the pull clip along the one or more channels, the pull clip including a receiver, the receiver facilitating the attachment of a cord or wand to the pull clip.

7 Claims, 16 Drawing Sheets

PULL CLIP FOR BOTTOM BAR OF WINDOW SHADE

FIELD OF THE INVENTION

This invention relates generally to window shades and other types of window coverings, and in particular to a new pull clip for the bottom bar of such a window shade.

BACKGROUND OF THE INVENTION

One common form of window shade comprises a fabric or other material that is wound upon a roller that is fixed or mounted to the top portion of the window frame. The fabric can be pulled downwardly and unrolled from the roller in order to block or minimize the amount of light infusion through the window. Later, when it is desired to allow unrestricted light to pass through the window, the fabric is typically wound back upon the roller through the use of one of a wide variety of different mechanical mechanisms. Most commonly the bottom portion of the fabric is fixed to a generally horizontal member that is generically referred to as a bottom bar. The bottom bar serves the purpose of finishing off the lower portion of the fabric, and also acts as an element of mass or weight that helps the fabric to hang taught and straight. Often the bottom bar is comprised of extruded plastic or aluminum.

Window shades are typically created in a wide variety of different lengths, including custom lengths, in order to accommodate windows of varying widths. To assist in the lowering of the shade a rope or cord pull, or in some cases a wand, may be attached to the mid-portion of the bottom bar. Since the window shade, and hence the bottom bar, may be of a variety of different widths, the particular location of the attachment of the pull cord or wand to the bottom bar will vary from window to window. It is therefore desirable to have a mechanism that permits the attachment of the pull cord or wand at various positions along the length of the bottom bar. Accordingly, the present invention concerns a mechanism that assists in the connection of a pull cord or wand to the bottom bar and that permits the pull cord or wand to be located at various positions along the length of the bottom bar.

SUMMARY OF THE INVENTION

The invention therefore provides a pull clip for the bottom bar of a window shade, the pull clip comprising a pair of arms joined by a bridge portion, said arms flexibly biased toward a rest position when displaced therefrom, at least a portion of said arms releasably receivable within one or more channels on the bottom bar, at least one of said arms or said bridge portion including an engagement member, said engagement member frictionally engaging the bottom bar when said arms are received within the one or more channels to restrain the movement of said pull clip along the one or more channels, said pull clip including a receiver, said receiver facilitating the attachment of a cord or wand to said pull clip.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION OF THE INVENTION

The present invention may be embodied in a number of different forms. The specification and drawings that follow describe and disclose some of the specific forms of the invention.

Figure 1:
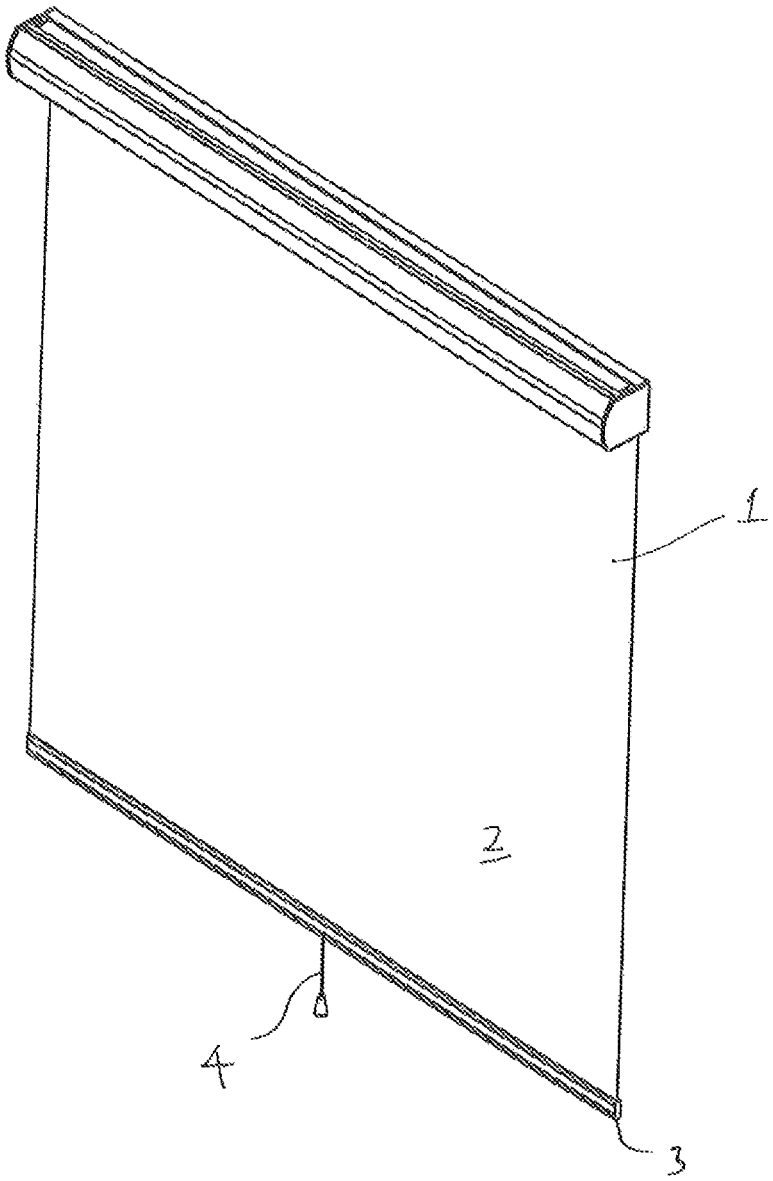
FIG. 1 is a side perspective view of a window shade.
Figure 2:
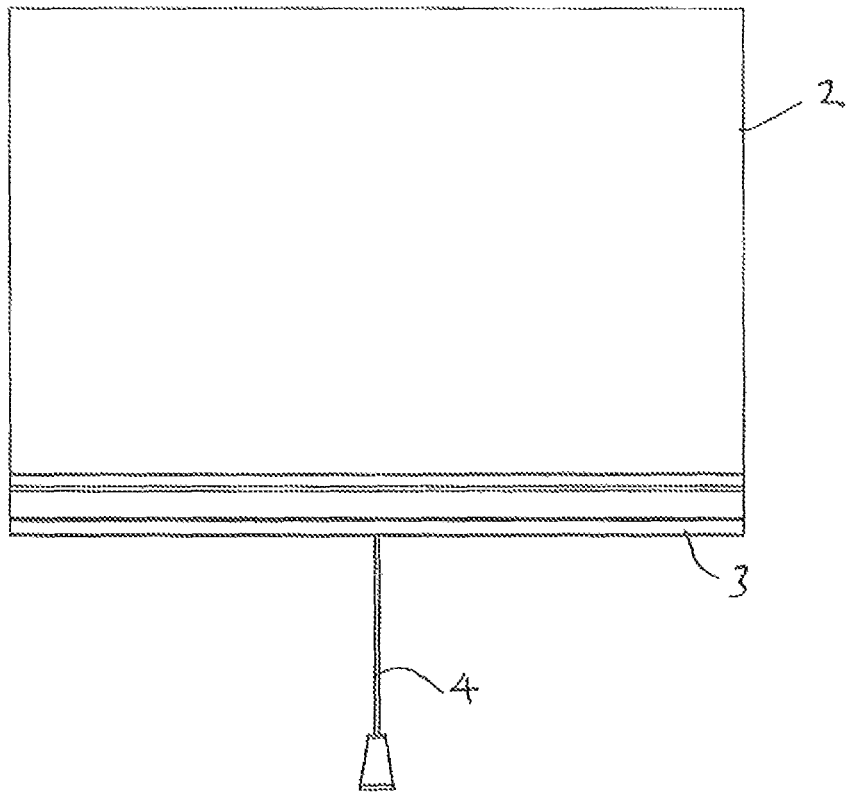
FIG. 2 is a front view of the window shade in a partially closed configuration.

In FIGS. 1 and 2 there is shown generally a window shade 1 that includes a shade fabric 2 and a bottom bar 3. Bottom bar 3 performs the general function of adding weight to the fabric in order to allow it to hang in a generally straight and taught configuration. The bottom bar also finishes off the lower edge of the fabric. A pull cord 4 is shown fixed generally to a mid-point of bottom bar 3 in order to assist in grasping and pulling the shade downwardly.

Figure 3:
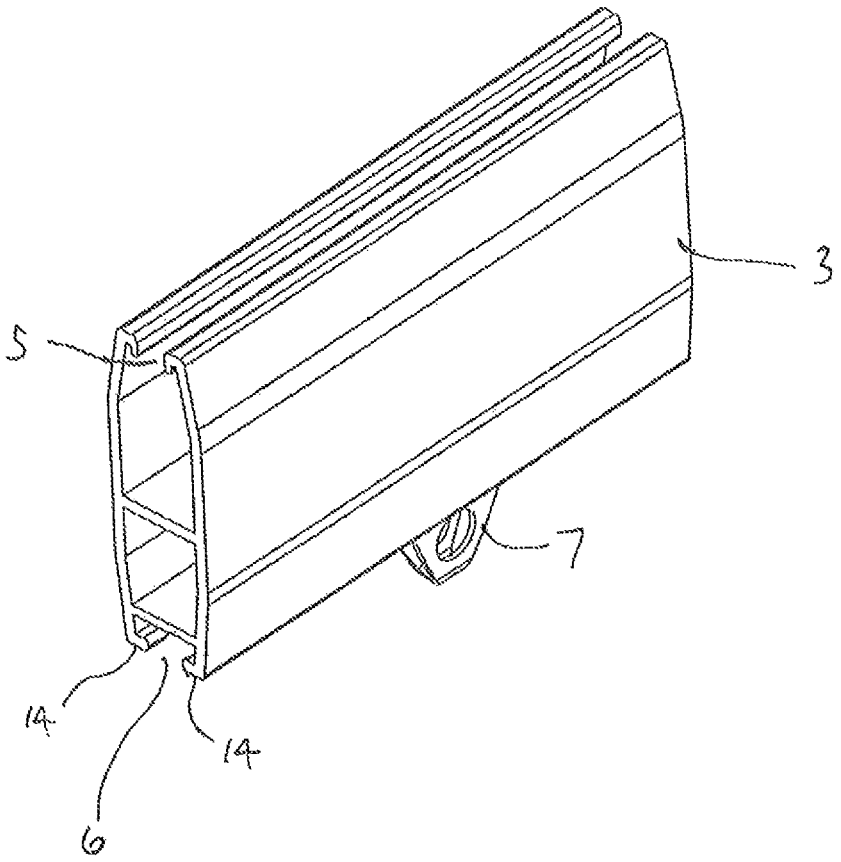
FIG. 3 is a side perspective view of a bottom bar of the window shade having attached thereto an embodiment of the pull clip in accordance with the present invention.
Figure 4:
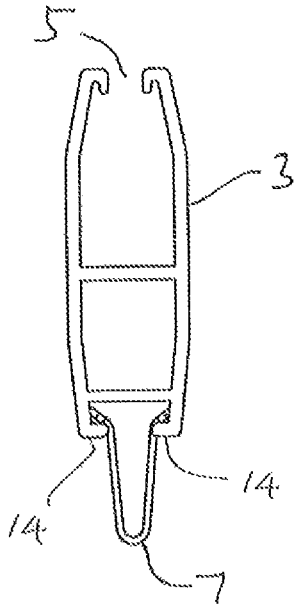
FIG. 4 is a vertical sectional view along the line 4-4 of FIG. 3.
Figure 5:
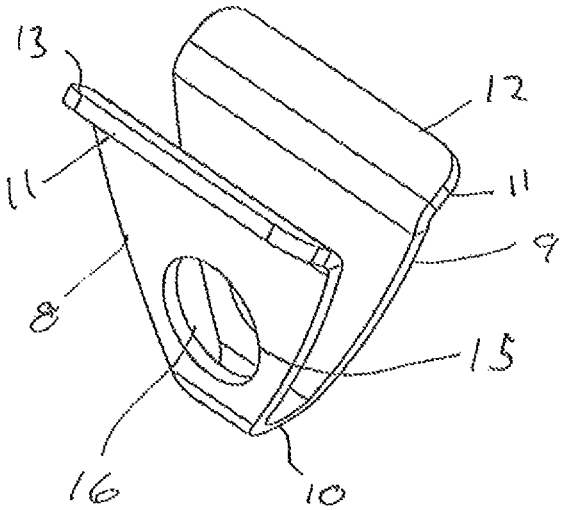
FIG. 5 is an upper side perspective view of the pull clip shown in FIG. 4.
Figure 6:
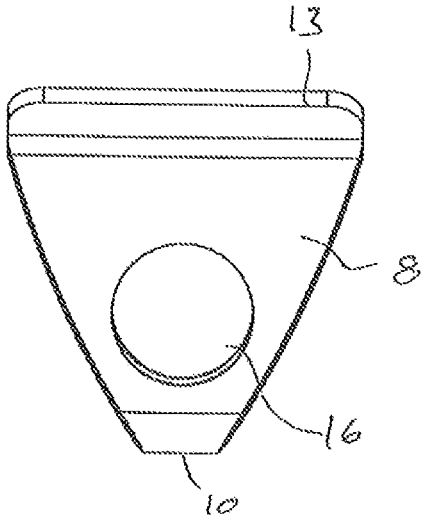
FIG. 6 is a side elevational view of the pull clip shown in FIG. 4.
Figure 7:
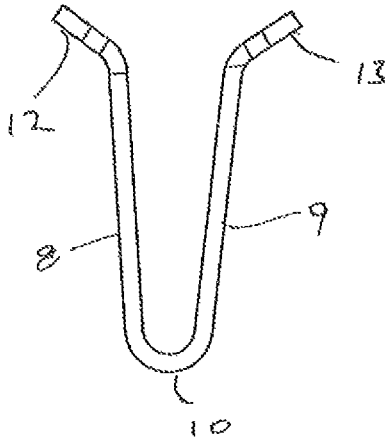
FIG. 7 is an end view of the pull clip shown in FIG. 4.
Figure 8:
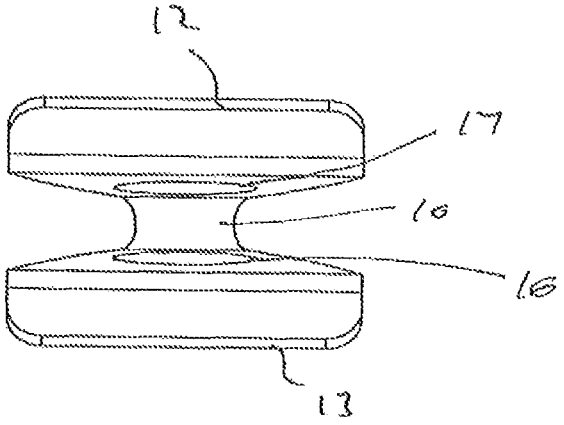
FIG. 8 is a top view of the pull clip shown in FIG. 4.
Figure 9:
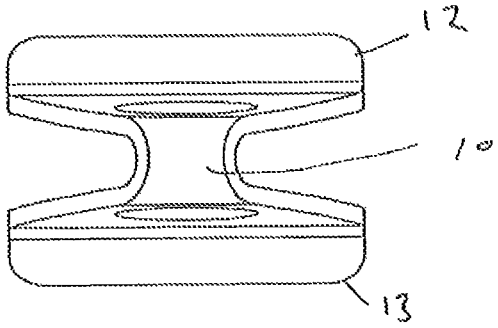
FIG. 9 is a bottom view of the pull clip shown in FIG. 4.
Figure 10:
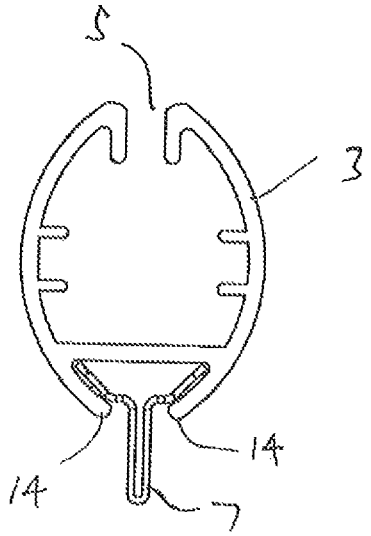
FIG. 10 is a vertical sectional view taken through the bottom bar and the pull clip shown in FIG. 3 wherein the pull clip is of an alternate embodiment.
Figure 11:
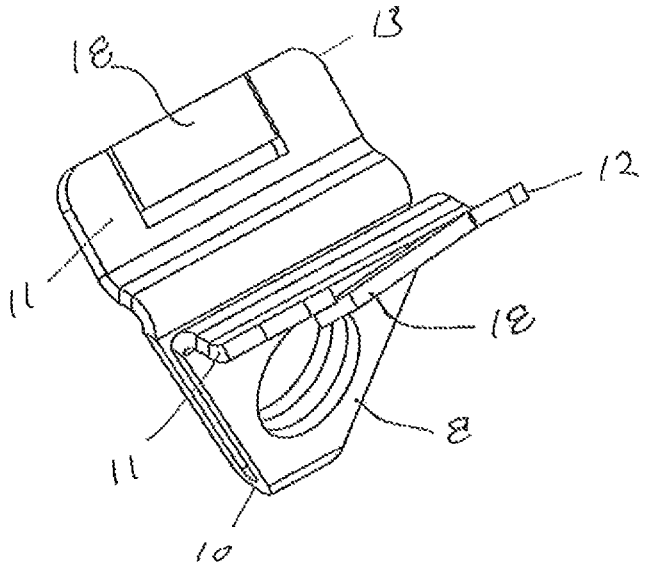
FIG. 11 is an upper side perspective view of the pull clip shown in FIG. 10.
Figure 12:
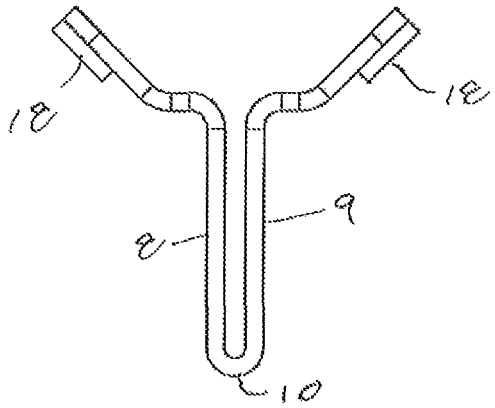
FIG. 12 is an end view of the pull clip shown in FIG. 11.
Figure 13:
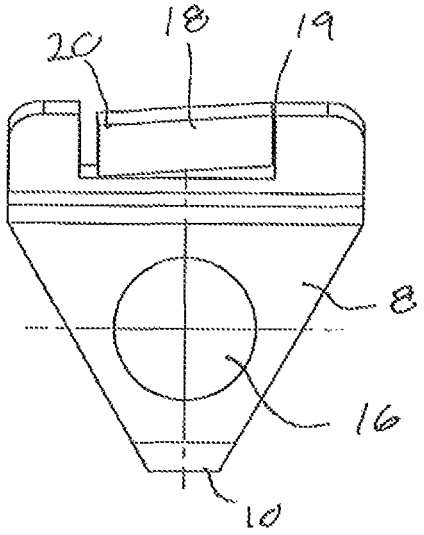
FIG. 13 is a right side view of the pull clip shown in FIG. 11.
Figure 14:
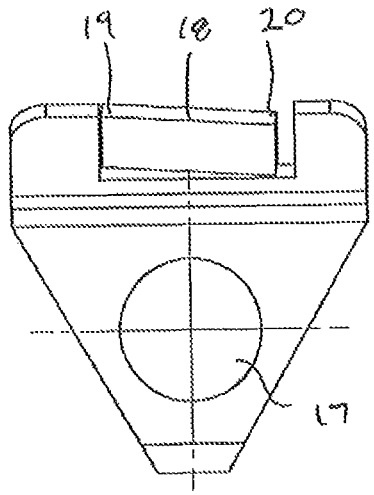
FIG. 14 is the left side view of the pull clip shown in FIG. 11.
Figure 15:
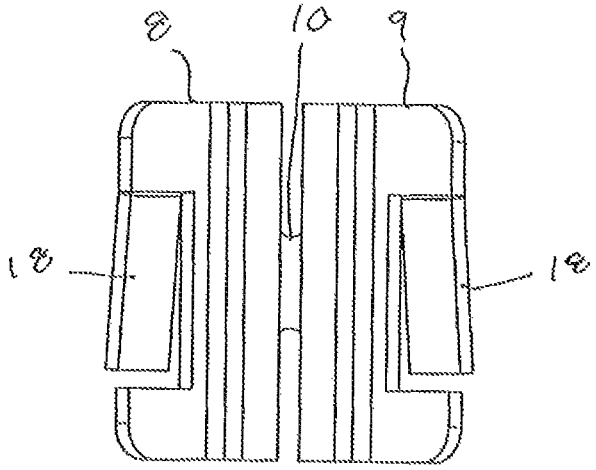
FIG. 15 is a top view of the pull clip shown in FIG. 11.
Figure 16:
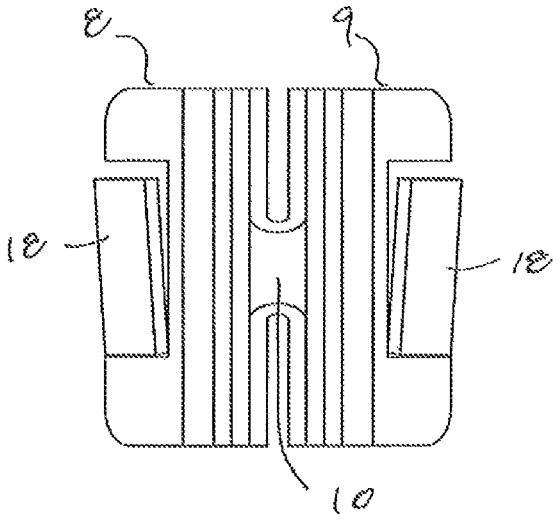
FIG. 16 is a bottom view of the pull clip shown in FIG. 11.
Figure 17:
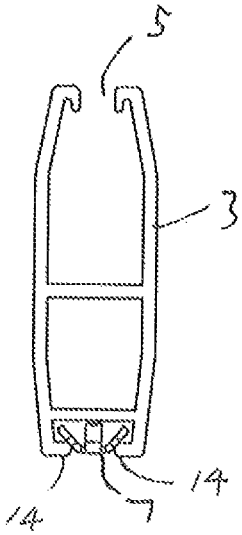
FIG. 17 is a vertical sectional view taken through a representative bottom bar and a pull clip shown in accordance with a further embodiment of the invention.
Figure 18:
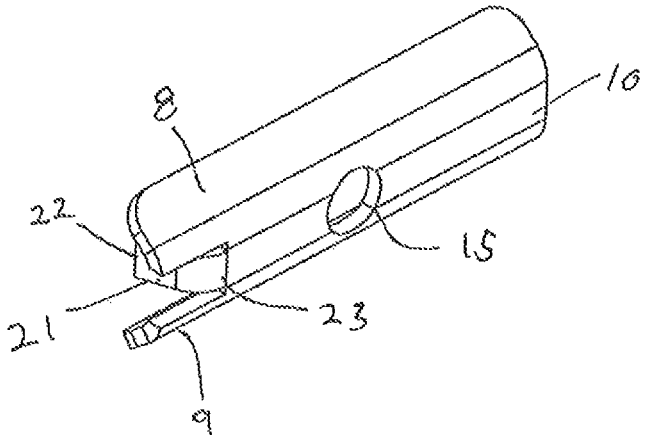
FIG. 18 is a side perspective view of the pull clip shown in FIG. 17.
Figure 19:
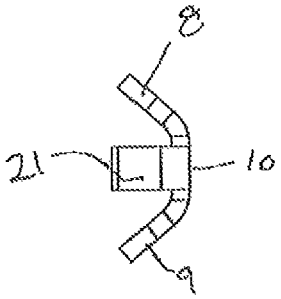
FIG. 19 is an end view of the pull clip shown in FIG. 18.
Figure 20:
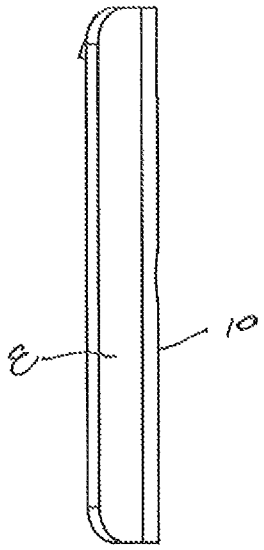
FIG. 20 is a side view of the end clip shown in FIG. 18.
Figure 21:
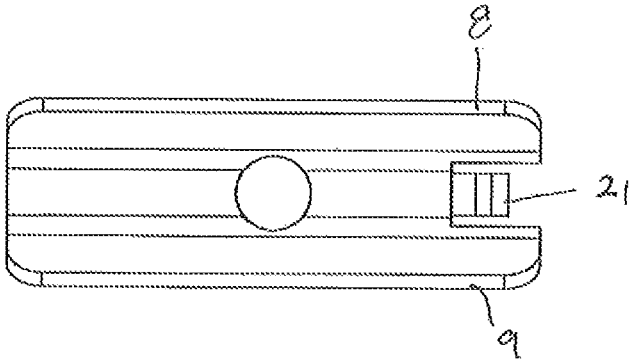
FIG. 21 is a top view of the pull clip shown in FIG. 18.
Figure 22:
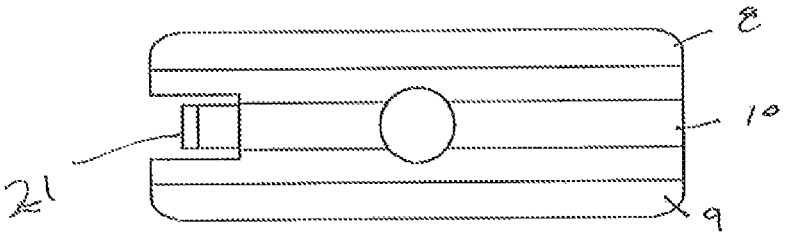
FIG. 22 is a bottom view of the pull clip shown in FIG. 18.
Figure 23:
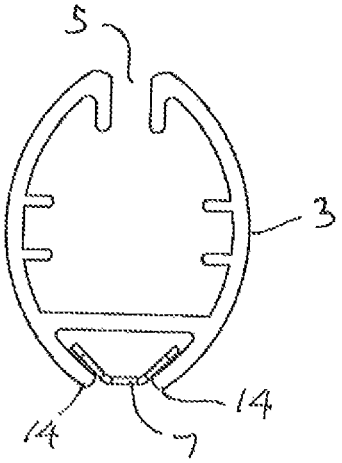
FIG. 23 is a vertical sectional view taken through a representative bottom bar and a pull clip in accordance with yet a further embodiment of the invention.
Figure 24:
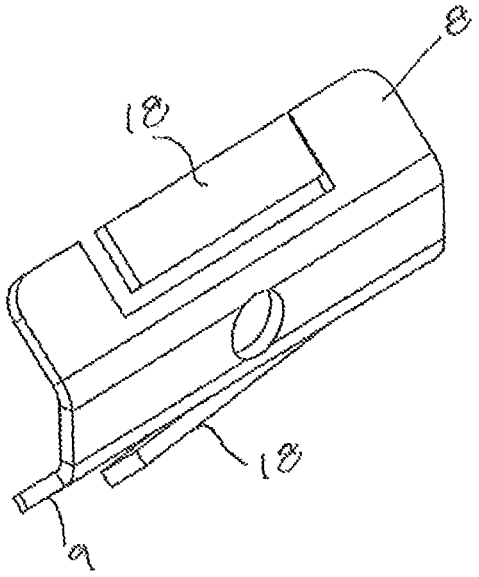
FIG. 24 is a side perspective view of the pull clip shown in FIG. 23.
Figure 25:
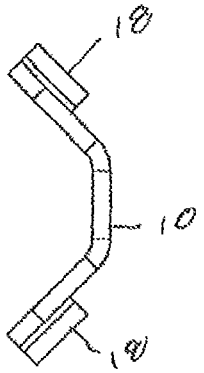
FIG. 25 is a left end view of the pull clip shown in FIG. 24.
Figure 26:
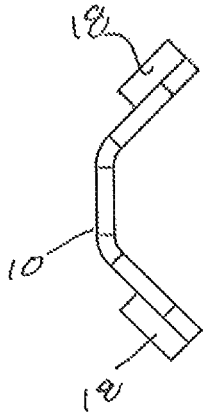
FIG. 26 is a right end view of the pull clip shown in FIG. 24.
Figure 27:
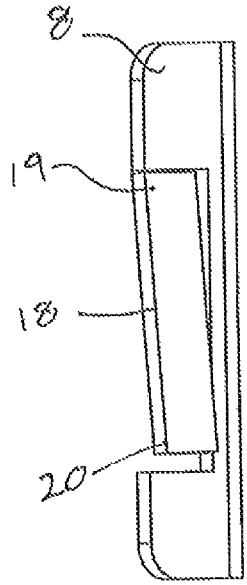
FIG. 27 is a side view of the pull clip shown in FIG. 24.
Figure 28:
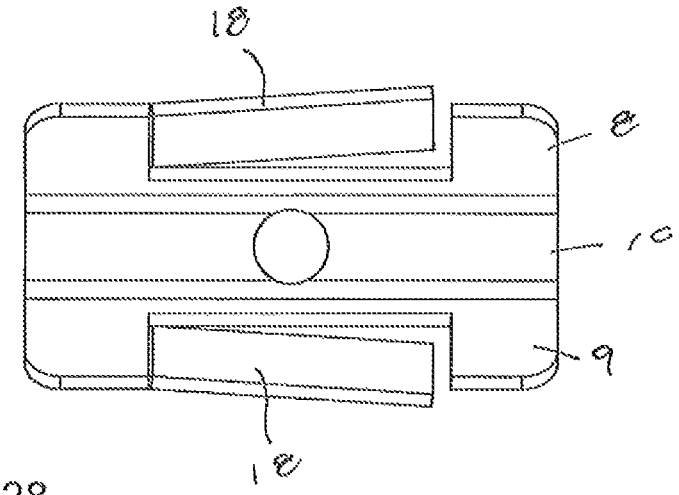
FIG. 28 is a top view of the pull clip shown in FIG. 24.
Figure 29:
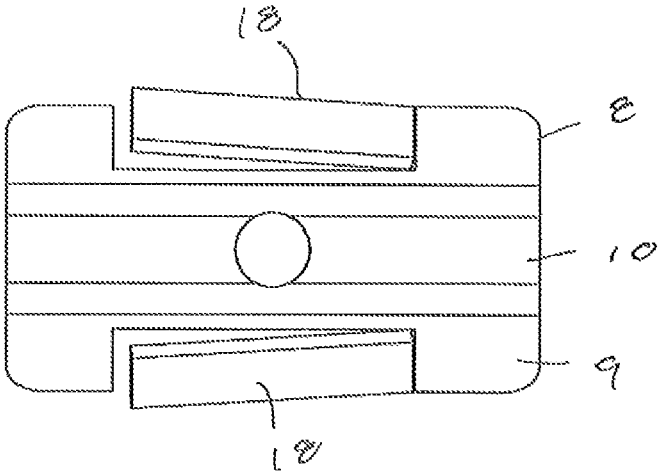
FIG. 29 is a bottom view of the pull clip shown in FIG. 24.

Commonly, bottom bar 3 will be formed from an extruded plastic or metal (for example aluminum). As shown in FIG. 3, the bottom bar will often have a slot or opening 5 along its upper surface to received shade fabric 2. A slot or channel 6 along the lower surface of the bottom bar presents the ability to secure pull cord 4, or in an alternate embodiment a wand (not shown), to the bottom bar, and indirectly to the shade fabric. In the embodiment of the bottom bar shown in the attached drawings a single channel 6 is positioned on the lower surface of the bar. However, it would be appreciated that in alternate embodiments one or more channels could be utilized.

FIGS. 4 through 9 show an embodiment of a pull clip 7 constructed in accordance with the present invention. Pull clip 7 is comprised generally of a pair of arms 8 and 9 that are joined by a bridge portion 10. Arms 8 and 9 are flexibly biased toward a rest position, when they are displaced therefrom, and extended generally upwardly from bridge portion 10 in a somewhat diverging manner. As shown specifically in FIG. 4, arms 8 and 9 are releasably receivable within channel 6 on the lower portion of the bottom bar. Preferably, the distance between the outer ends of arms 8 and 9 is greater than the opening of channel 6 such that insertion of pull clip 7 into channel 6 requires the arms to be deflected inwardly toward one another, or, alternatively, slid into the channel through insertion at the end of the bottom bar.

At least one of arms 8 and 9 and/or bridge portion 10 includes an engagement member 11. Engagement member 11 frictionally engages the bottom bar when the arms are received within channel 6 in order to restrain the movement of clip 7 along the length of the channel. In the embodiment of the invention shown in FIGS. 4 through 9, engagement members 11 comprise inclined terminal edges (12 and 13 respectively) on the ends of arms 8 and 9. As shown more specifically in FIGS. 5 and 7, terminal edges 12 and 13 preferably comprise outwardly extended portions at the ends of each of arms 8 and 9 that, when received within channel 6, enhance the frictional engagement of the clip with the bottom bar and also serve to effectively "hang" the clip from inwardly directed flanges 14 that define channel 6. Preferably the distance between the edges of flanges 14 is less than the spacing between arms 8 and 9 such that the arms are compressed toward one another when received within channel 6. When they are deflected inwardly from their rest position the arms will be biased in an outward direction, having the tendency to drive inclined terminal edges 12 and 13 into contact with the interior surface of the bottom bar and further enhancing the engagement of pull clip 7 therewith.

It will be appreciated that the described structure permits the location of pull clip 7 along the length of channel 6 to be easily adjusted through merely compressing arms 8 and 9 together slightly to relieve at least some of the contact of terminal edges 12 and 13 with the bottom bar, and thereafter sliding the pull clip along the length of channel 6 to its desired position. Once the pull clip is in position, releasing the arms causes them to be once again biased in an outward direction thereby resulting in terminal edges 12 and 13 being driven into the interior surface of the bottom bar, and hence holding the pull clip in position and resisting its further movement.

Pull clip 7 further includes a receiver 15 to facilitate the attachment of cord 4 (or a wand). In the embodiment of the invention shown in FIGS. 4 through 9, receiver 15 is comprised of a pair of aligned holes 16 and 17 that extend through arms 8 and 9. Cord 4 may be threaded through holes 16 and 17 and attached thereto or, alternately, a clevis, harness or swivel may be secured to holes 16 and 17, to which a cord or wand may be attached.

FIGS. 10 through 16 show an alternate embodiment of pull clip 7. In this embodiment arms 8 and 9 have lower portions that are generally parallel and that then abruptly offset to form inclined terminal edges 12 and 13. This particular embodiment of pull clip 7 accommodates a slightly different configuration of bottom bar 3 and presents a different visual appearance wherein the lower portions of the arms (i.e. that portions that are typically viewed by the consumer) are relatively close together and in a parallel configuration. In this embodiment there is also shown a alternate example of engagement member 11 wherein the engagement member comprises a pair of flexibly resilient tabs 18 positioned on arms 8 and 9 and receivable within channel 6. In the particular embodiment shown, there is a tab 18 on each of arms 8 and 9. In alternate embodiments it may be desirable to place a tab on only one of the arms. Referring specifically to FIGS. 11 through 14, tabs 18 have a fixed end 19 that secures them to one of arms 8 and 9 and a free end 20 that is displaced downwardly with respect to the plane of the arm. The downwardly displaced position of free end 20 is the rest configuration of tabs 18. Tabs 18 are biased toward their rest positions when displaced therefrom. From an examination of FIGS. 10 through 16, and an appreciation of the structure shown, it will be understood that bottom bar 3, channel 6 and pull clip 7 will be configured such that when the pull clip is inserted into channel 6 arms 8 and 9 will preferably be displaced slightly inwardly from their rest position. As such, the arms will be biased outwardly causing inclined terminal edges 12 and 13 to frictionally engage against the inner surface of the bottom bar, thereby resisting or restraining the movement of the clip along the length of the channel. Further, free ends 20 of tabs 18 will have a tendency to "bite" into the inner surface of the bottom bar which they contact, further assisting in restraining of the movement of the clip along the length of the channel. In some cases the physical dimensions of pull clip 7 and the interior of the bottom bar about channel 6 will be such that when the pull clip is inserted into the channel tabs 18 will be deflected from their rest position, thereby causing the tabs to apply a further biasing force and increasing the frictional contact between the pull clip and the bottom bar.

FIGS. 17 through 22 show a further embodiment of pull clip 7. In this instance arms 8 and 9 may not specifically include inclined terminal edges 12 and 13 as in the case of the previously described embodiments. Here, the arms tend to diverge from bridge portion 10 to a greater extent such that their physical separation retains them within channel 6 through effectively hanging the arms from flanges 14 that define the channel. In the particular embodiment shown, bridge portion 10 includes one or more upwardly directed resilient tabs 21 that have a free end 22 and a fixed end 23 that attaches the tabs to the bridge portion. Tab 21 is biased towards its rest position when displaced therefrom and is inclined at an angle relative to the bridge member. When pull clip 7 is inserted into channel 6 tab 21 will contact the interior of bottom bar 3 to help restrain movement of clip 7. The tab may be displaced slightly from its rest position through engagement of the free end of the tab with an internal surface of the bottom bar. It will thus be appreciated that the interaction of free end 22 with the internal surface of the bottom bar causes a frictional engagement between the bottom bar and the pull clip thereby helping to restrain movement of the clip along the length of the channel. In this embodiment of the pull clip, receiver 15 comprises a hole positioned in bridge portion 10 which can receive a cord, wand, harness, swivel or other such structure.

FIGS. 23 through 29 depict yet a further embodiment of pull clip 7. The embodiment shown in these Figures is somewhat of a hybrid of the embodiment shown in FIGS. 17 through 22 and FIGS. 10 through 16. In FIGS. 23 through 29 the pull clip is generally of the same configuration as that described above with respect to FIGS. 17 though 22, with the exception that bridge portion 10 does not contain a tab 21. Instead, arms 8 and 9 contain tabs 18, similar to those described with respect to FIG. 10 through 16.

In each of the above described embodiments of pull clip 7, the clip will most often be formed of a single piece of flexibly resilient material. In most instances it is expected that the clip will be a flexibly resilient metal. To assist in manufacturing and to minimize costs, it is anticipated that the pull clip will often be cut or stamped from a single sheet of material or molded as a single part. Where necessary and appropriate the clip may be bent or formed into its desired configuration. The particular embodiment that is utilized, will largely depend upon the specific nature and structure of bottom bar 3 and channel 6.

It will thus be appreciated from an understanding of the invention that there is provided a pull clip for the bottom bar of a window shade that may be easily and readily secured within a channel on the lower surface of the bottom bar, that may be slid and positioned along the length of the bar to a wide variety of different locations, and that once in its desired position will exhibit a tendency to remain in place and to restrain against further movement along the length of the bar.

It is to be understood that what has been described are the preferred embodiments of the invention. The scope of the claims should not be limited by the preferred embodiments set forth above, but should be given the broadest interpretation consistent with the description as a whole.

What is claimed is:

1. A pull clip and a bottom bar of a window shade, the pull clip comprising a pair of arms joined by a bridge portion, said arms flexibly biased toward a rest position when displaced therefrom, at least a portion of said arms being releasably received within one or more channels on the bottom bar, at least one of said arms or said bridge portion including an engagement member, said releasable receipt of said arms within the one or more channels causing said engagement member to frictionally engage the bottom bar to restrain the movement of said pull clip along the one or more channels, said pull clip including a receiver, said receiver facilitating the attachment of a cord or wand to said pull clip.

2. The pull clip as claimed in claim 1 wherein said engagement member comprises one or more flexibly resilient tabs positioned on the portion of said arms that is receivable within the one or more channels of the bottom bar, said one or more tabs biased toward a rest position when displaced therefrom, said one or more tabs releasably received within the one or more channels so that said one or more tabs frictionally engage the bottom bar and retain said pull clip within the one or more channels.

3. The pull clip as claimed in claim 2 wherein said receiver is a hole in said bridge portion or a pair of aligned holes in said arms.

4. The pull clip as claimed in claim 1 wherein said engagement member comprises inclined terminal edges on said arms, said terminal edges enhancing the frictional engagement of said arms with the bottom bar.

5. The pull clip as claimed in claim 4 wherein said receiver is a hole in said bridge portion or a pair of aligned holes in said arms.

6. The pull clip as claimed in claim 1 wherein said engagement member comprises one or more resilient tabs positioned on said bridge portion, said one or more tabs biased toward a rest position when displaced therefrom, said one or more tabs displaced from their rest position when said arms are received within the one or more channels such that said one or more tabs frictionally engage the bottom bar and enhance the retaining of said pull clip within the one or more channels.

7. The pull clip as claimed in claim 6 wherein said receiver is a hole in said bridge portion or a pair of aligned holes in said arms.

* * * * *